US007478992B2

(12) United States Patent
Hsu et al.

(10) Patent No.: US 7,478,992 B2
(45) Date of Patent: Jan. 20, 2009

(54) HEAT-DISSIPATING DEVICE

(75) Inventors: Wei-Chun Hsu, Taoyuan (TW); Shun-Chen Chang, Taoyuan (TW); Wen-Shi Huang, Taoyuan (TW); Hsiou-Chen Chang, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 463 days.

(21) Appl. No.: 11/150,235

(22) Filed: Jun. 13, 2005

(65) Prior Publication Data

US 2005/0260072 A1 Nov. 24, 2005

Related U.S. Application Data

(63) Continuation-in-part of application No. 10/848,074, filed on May 19, 2004, now Pat. No. 7,241,110.

(30) Foreign Application Priority Data

Jun. 18, 2004 (TW) ..... 93117625 A

(51) Int. Cl.
*F01D 5/14* (2006.01)

(52) U.S. Cl. ..... 415/184; 416/189

(58) Field of Classification Search ..... 415/185, 415/191, 208.2, 229; 416/189
See application file for complete search history.

(56) References Cited

U.S. PATENT DOCUMENTS

| | | | | |
|---|---|---|---|---|
| 2,293,508 | A * | 8/1942 | Killam | 416/92 |
| 3,846,039 | A * | 11/1974 | Stalker | 415/206 |
| 4,320,431 | A * | 3/1982 | Bell | 416/208 |
| 5,188,508 | A | 2/1993 | Scott et al. | |
| 5,213,473 | A * | 5/1993 | Fiala | 416/183 |
| 5,982,064 | A | 11/1999 | Umeda et al. | |
| 5,997,246 | A | 12/1999 | Humbad | |
| 6,179,561 | B1 | 1/2001 | Horng | |
| 7,052,236 | B2 * | 5/2006 | Chang et al. | 415/191 |

FOREIGN PATENT DOCUMENTS

| | | | |
|---|---|---|---|
| CN | 1208822 | A | 2/1999 |
| CN | 2311639 | Y | 3/1999 |
| CN | 1369671 | A | 9/2002 |
| CN | 2533304 | Y | 1/2003 |
| DE | 20309621 | U1 | 10/2003 |
| DE | 10251463 | A1 * | 5/2004 |
| JP | 63-306298 | A | 12/1988 |
| JP | 01-167499 | A | 7/1989 |
| JP | 53-10402 | A | 11/1993 |
| JP | 2000-287408 | A | 10/2000 |
| JP | 2002-70791 | A | 3/2002 |
| JP | 2003-003998 | A | 1/2003 |
| JP | 2003-065298 | A | 3/2003 |

* cited by examiner

*Primary Examiner*—Igor Kershteyn
(74) *Attorney, Agent, or Firm*—Birch, Stewart, Kolasch & Birch, LLP

(57) ABSTRACT

A heat-dissipating device includes a housing having a first frame and a second frame, and a rotor disposed in the housing, wherein the first frame includes a bearing tube for accommodating a first bearing therein and the second frame includes a support for accommodating a second bearing therein so as to jointly support a shaft of the rotor. The heat-dissipating device utilizes a two-side way for securing its rotating shaft so as to enhance the stability and eliminate the vibration while operating at high rotation speed.

19 Claims, 5 Drawing Sheets

HEAT-DISSIPATING DEVICE

FIELD OF THE INVENTION

The present invention is a continuation-in-part application of the parent application bearing Ser. No. 10/848,074 and filed on May 19, 2004 now U.S. Pat. No. 7,241,110. The present invention relates to a heat-dissipating device, and in particular to a high-pressure centrifugal fan with a two-side way for securing its rotating shaft.

DESCRIPTION OF THE RELATED ART

In FIG. 1A, a conventional blower 1 includes a frame 10, a motor 11, an impeller 12 and a cover 13. The frame 10 includes an opening 101 as an air outlet and the cover 13 has a circular opening 131 as an air inlet. The way from the air inlet to the air outlet constitutes an airflow passage. The motor 11 is disposed on a base 102 of the frame 10 to drive the impeller 12. The impeller 12 includes a hub 121, an annular plate 122, and a plurality of blades 123 disposed on the upper side and the lower side of the annular plate 122 and circumferentially disposed around the hub 121.

However, in this conventional blower, the motor is commonly fixed on the single side as shown in FIGS. 1B and 1C. In FIG. 1B, a single bearing 14 is mounted in the base 102 for fixing and supporting the shaft 15. In FIG. 1C, two bearings 141,142 are mounted in the base 102 to fix and support the shaft 15. However, when such designs are applied to high-speed or high-pressure blowers, it will easily cause an unstable situation, thereby worsening the vibration while operating.

SUMMARY OF THE INVENTION

An object of the present invention is to provide a heat-dissipating device with a two-side way for securing its rotating shaft.

According to the present invention, the heat-dissipating device includes a housing having a first frame and a second frame, and a rotor disposed in the housing, wherein the first frame includes a bearing tube for accommodating a first bearing therein and the second frame includes a support for accommodating a second bearing therein so as to jointly support a shaft of the rotor.

Preferably, the second frame further comprises an extending part axially extending toward a direction of the first frame to form an axially compressed airflow passage in the housing.

The rotor includes a base, a hub, a first set of blades and a second set of blades, wherein the first set of blades extends downward from a periphery of the hub to a surface of the base and the second set of blades is disposed on the base. The base, the hub, the first and second sets of blades can be integrally formed as a single unit.

In addition, the heat-dissipating device further includes a driving device disposed in the hub for driving the rotor to rotate.

The housing further includes at least one air inlet formed on the second frame, and an air outlet defined after the first and second frames are assembled. The second frame has a sidewall extending from a periphery of the air inlet inwardly to define an air-gathering chamber in the housing, wherein the sidewall has a flange at one end thereof extending radially to define an entrance of the air-gathering chamber. The rotor has a plurality of blades extending toward the entrance of the air-gathering chamber for guiding the airflow into the air-gathering chamber. The air-gathering chamber partially or completely overlaps an air passage through the rotor in height along an axis of the heat-dissipating device, and the air-gathering chamber has a cross-sectional area substantially identical to that of the air outlet of the housing.

Additionally, the housing further includes a plurality of air-guiding members arranged between the sidewall and the support for increasing a blast pressure of airflow passing through the heat-dissipating device, wherein the plurality of air-guiding members can be fixed on the sidewall or the support. The plurality of air-guiding members are shaped as strip, plate, curved, inclined or airfoil structures. Preferably, each of the plurality of air-guiding members has an inclined angle.

BRIEF DESCRIPTION OF THE DRAWINGS

The present invention is more fully understood by reading the subsequent detailed description and examples with references made to the accompanying drawings, wherein.

DETAILED DESCRIPTION OF THE INVENTION

Figure 1A:
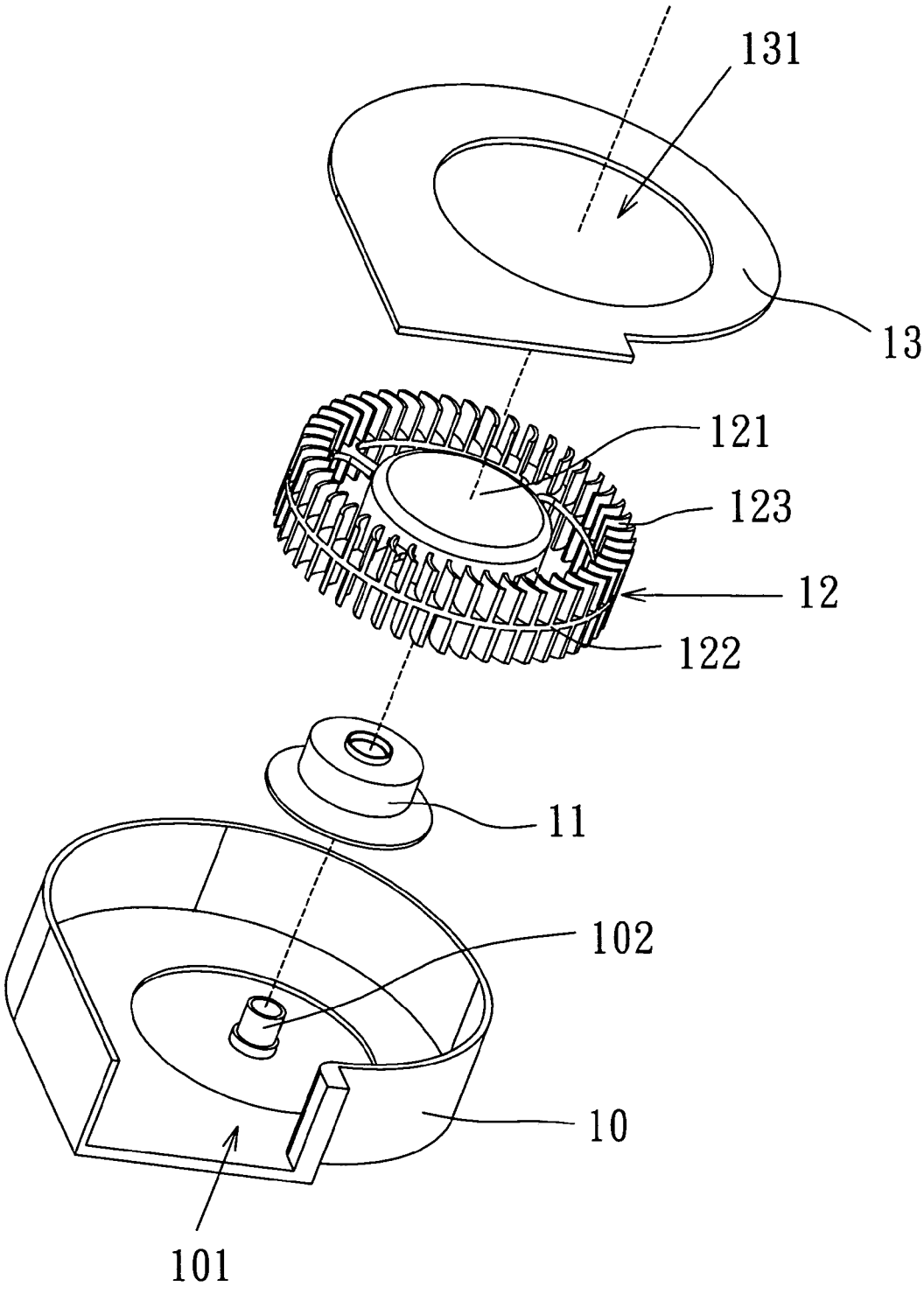
Fig. 1A(Prior Art)
FIG. 1A is an exploded view of a conventional blower.
Figure 1B:
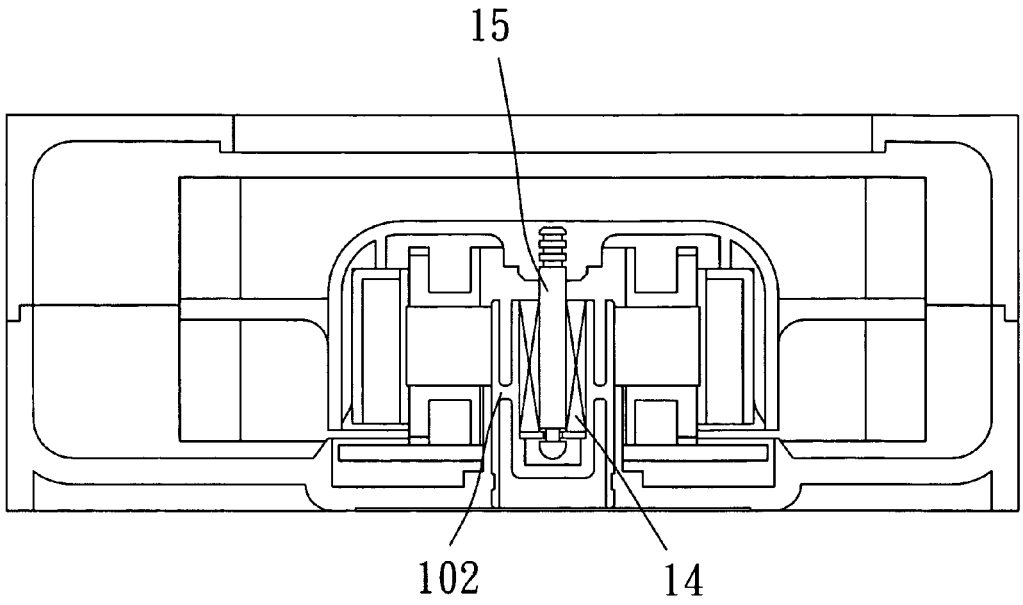
Fig. 1B(Prior Art)
FIG. 1B is a sectional view of the first motor fixed type of the conventional blower.
Figure 1C:
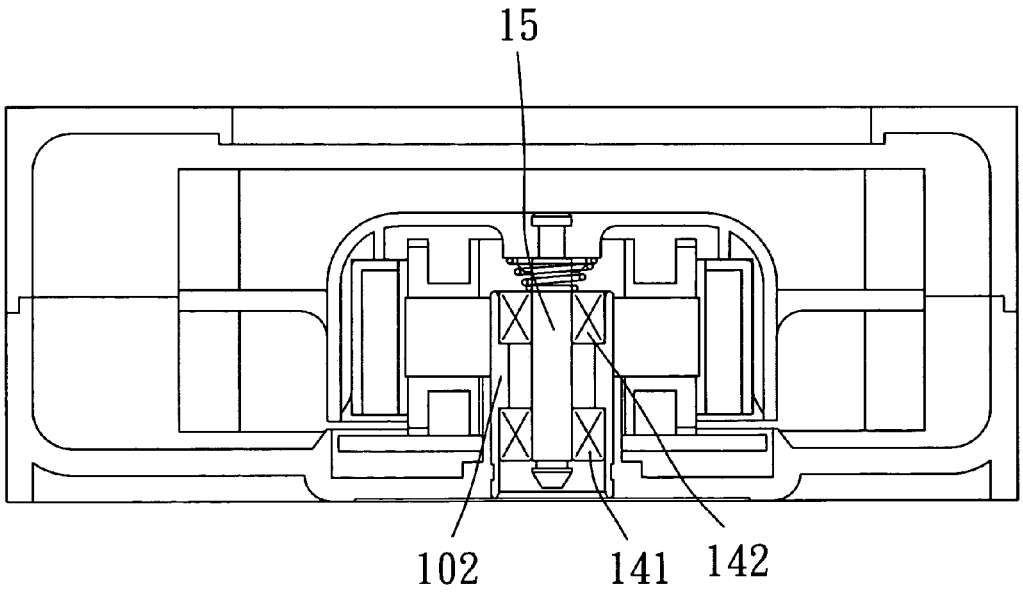
Fig. 1C(Prior Art)
FIG. 1C is a sectional view of the second motor fixed type of the conventional blower.
Figure 2A:
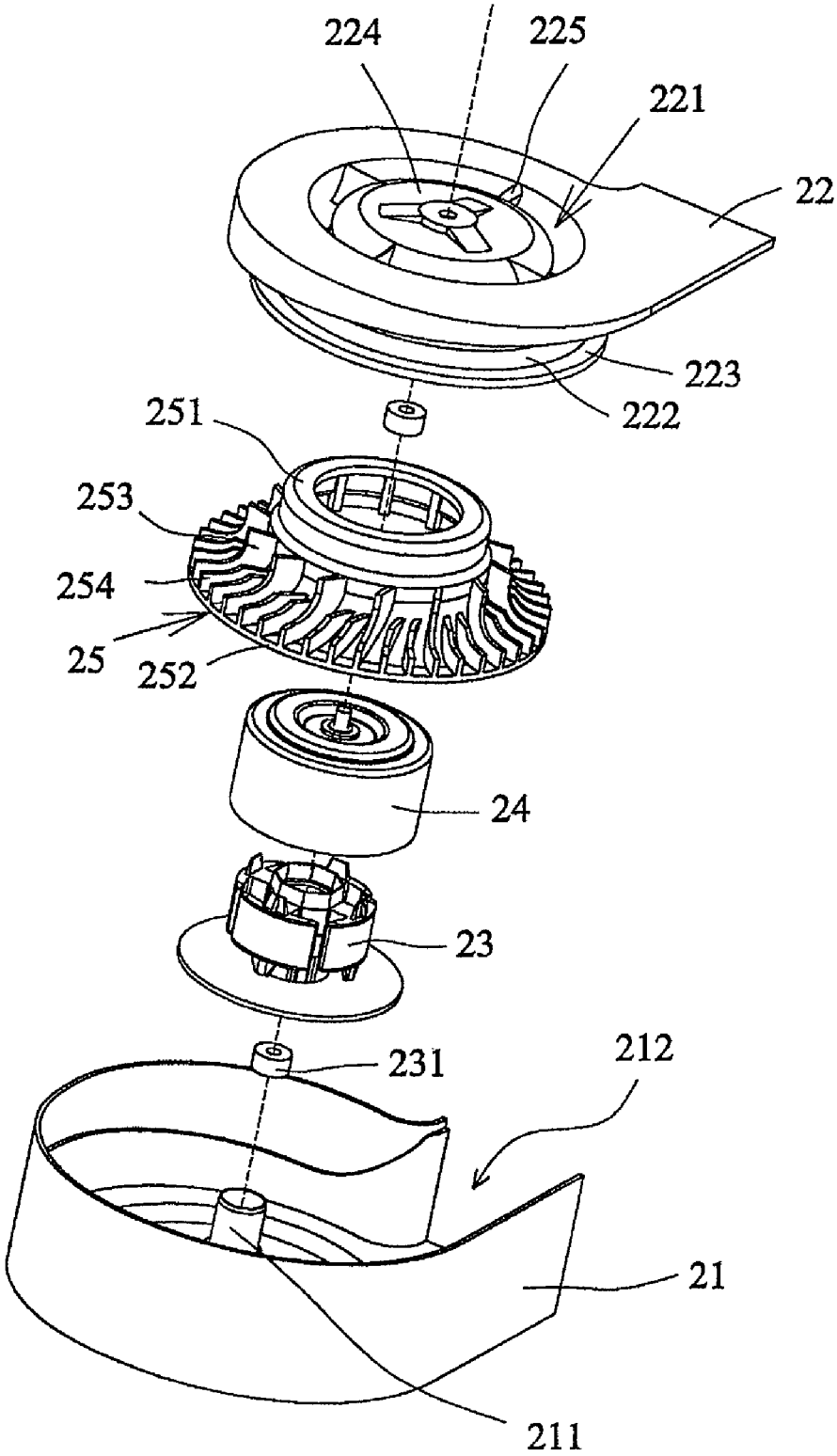
FIG. 2A is an exploded view of a heat-dissipating device according to an embodiment of the present invention.
Figure 2B:
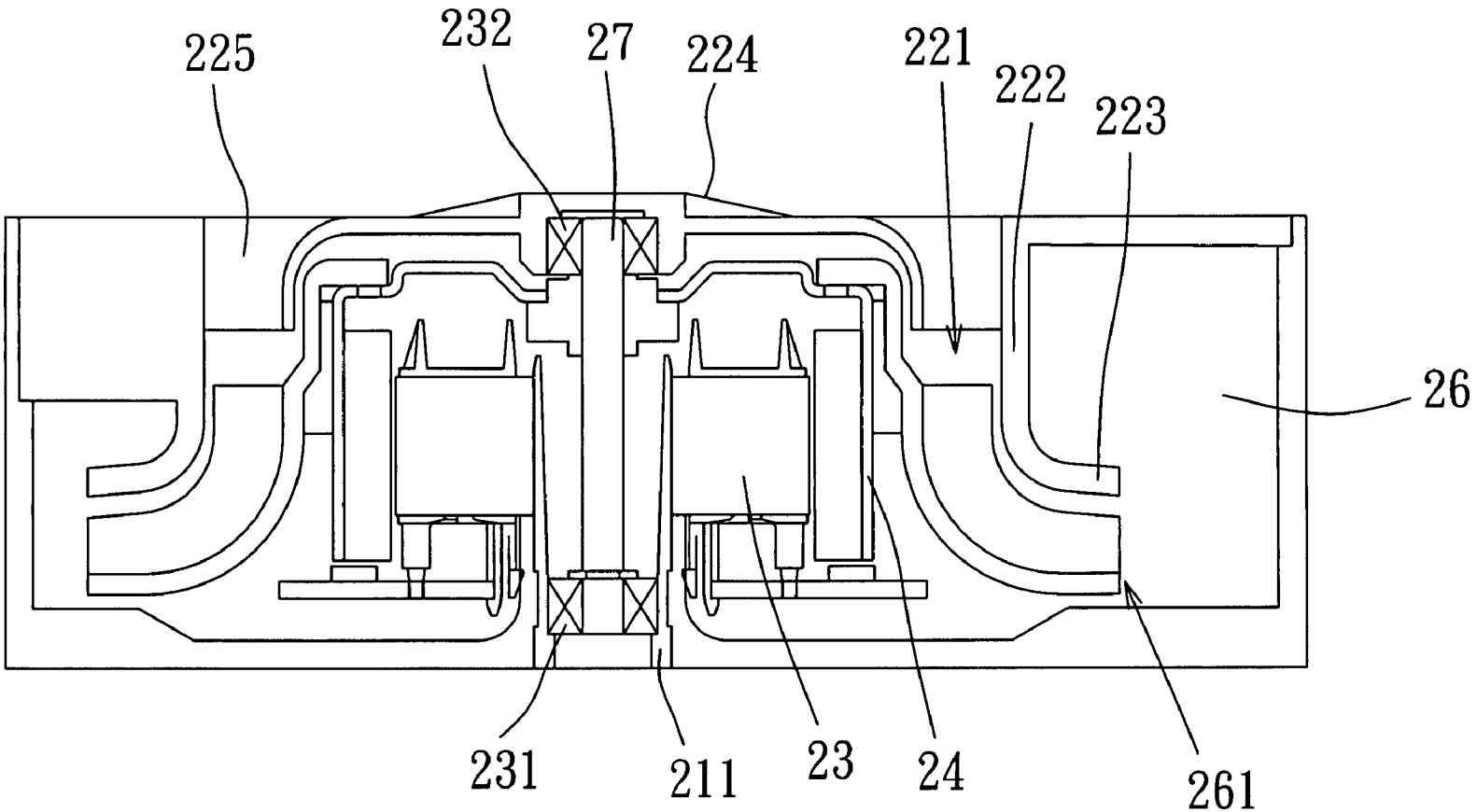
FIG. 2B is a sectional view of the heat-dissipating device of FIG. 2A after being assembled.
Figure 2C:
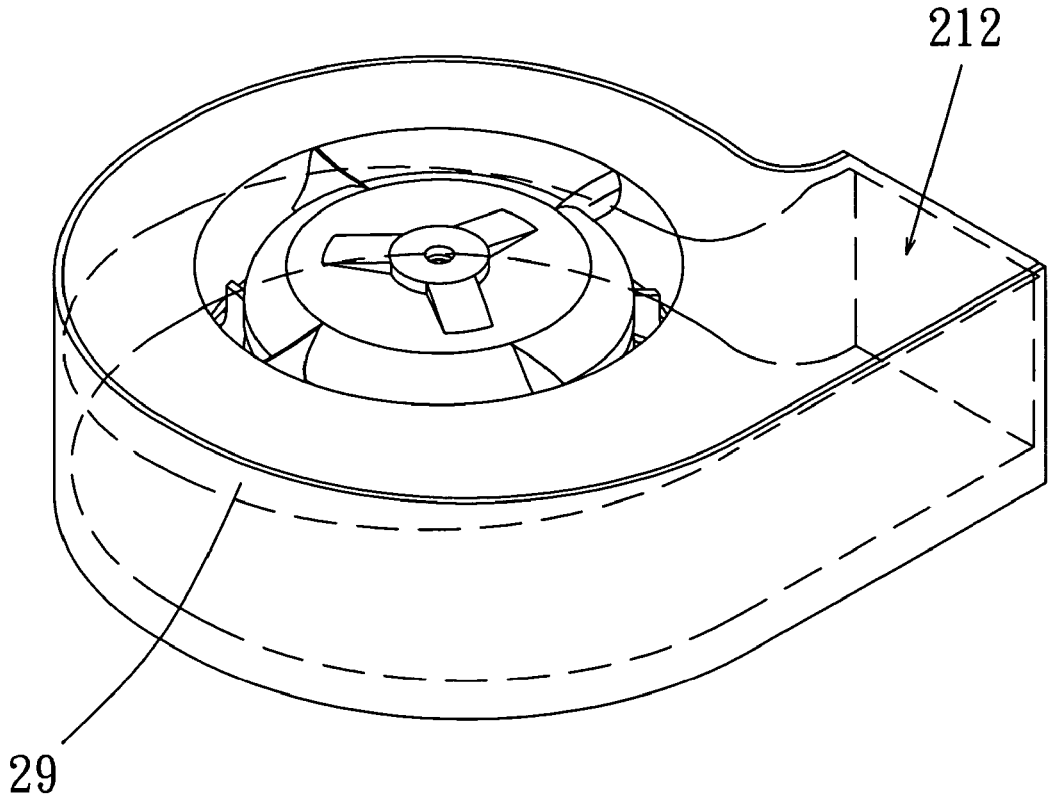
FIG. 2C is a perspective view of a heat-dissipating device of FIG. 2A after being assembled.

Please refer to FIGS. 2A~2C showing the first embodiment of the heat-dissipating device of the present invention. The heat-dissipating device is exemplified by a centrifugal fan, which is a single-suction blower. The heat-dissipating device includes a housing constituted by a first frame 21 and a second frame 22, a driving device 23, a metallic shell 24 and a rotor 25.

The first frame 21 includes a bearing tube 211 for receiving and supporting the driving device 23 and the bearing 231 is mounted inside the bearing tube 211 for supporting a rotating shaft 27 of the rotor 25. The second frame 22 includes an air inlet 221 and a sidewall 222 extending downward from an inner margin of the air inlet 221. When the first frame 21 and the second frame 22 are assembled together, a space will be formed inside the heat-dissipating device and can be divided to an air-gathering chamber 26 and a partition for disposing the rotor 25 therein by the sidewall 222. An air outlet 212 is also formed simultaneously as shown in FIG. 2C. A flange 223 is radially extending from the bottom of the sidewall 222 to define an entrance 261 of the air-gathering chamber 26.

The rotor 25 includes a hub 251, a base 252 radially extending from the bottom end of the hub 251, a first set of blades 253 and a second set of blades 254, and is driven by the driving device 23 coupled inside the hub 251. The first and second sets of blades 253, 254 are curved blades disposed on the base 252, respectively, and each blade has one end extending toward the entrance 261 of the air-gathering chamber 26, wherein the first set of blades is extended downward from the outer periphery of the hub 251 to the surface of the base 252. The first and second sets of blades are alternately arranged as shown in FIG. 2A. The hub 251, the base 252 and the blades 253, 254 can be integrally formed as a monolithic piece by injection molding.

The second frame 22 further has a support 224 mounted inside the air inlet and a plurality of air-guiding members 225 are disposed between the support 224 and the sidewall 222 for increasing the blast pressure of the heat-dissipating device.

As the rotor 25 rotates, the airflow is intaked into the air inlet 221, passes through the air-guiding members 225 and the blades 253, 254, and is guided into the air-gathering chamber 26 via the entrance 261. In the air-gathering chamber 26, the airflow is gradually collected and discharged therefrom to the exterior at a high pressure via the air outlet 212, which can prevent the sudden change of the airflow pressure. Thus, the airflow sequentially passes through the air inlet 221, the air-guiding members 225, the blades 253, 254 and the entrance 261 of the air-gathering chamber 26.

Because the sidewall 222 extends downward from the inner margin of the air inlet 221 and separates the air-gathering chamber 26 from the rotor 25 and the size of the air outlet 212 is reduced, time of airflow pressurization by the rotor 25 is increased such that the variation in airflow pressure are stabilized. Further, because the height of the air-gathering chamber 26 partially or completely overlaps that of the flow passage through the rotor 25 and the air-guiding members 225 in the axial direction, the occupied space of the centrifugal fan can be minimized. The cross-sectional area of the air-gathering chamber 26 is substantially equal in size to that of the air outlet 212 such that airflow can constantly and stably flow within the air-gathering chamber 26 and the air outlet 212 to prevent work loss.

On the other hand, the present invention adopts a two-side motor fixed design, as shown in FIG. 2B, the first bearing 231 is mounted inside the bearing tube 211 and the second bearing 232 is mounted on the inner side of the support 224 of the second frame 22 for jointly supporting the shaft 27 of the rotor 25 together so as to provide the stabilization of the centrifugal fan under the high-speed operation and eliminate the vibration. Certainly, the first and second bearings can be ball bearings or sleeve bearings.

As shown in FIG. 2A or 2C, the second frame 22 has an extending part 29 formed on an inner side thereof and axially extending toward the direction of the first frame 21 to form an axially compressed airflow passage in the housing.

In conclusion, the present invention provides a heat-dissipating device utilizing a two-side way for securing its rotating shaft so as to enhance the stability and eliminate the vibration while operating at high rotation speed.

While the invention has been described in connection with what is presently considered to be the most practical and preferred embodiment, it is to be understood that the invention is not limited to the disclosed embodiments, but, on the contrary, is intended to accommodate various modifications and equivalent arrangements included within the spirit and scope of the appended claims.

What is claimed is:

1. A heat-dissipating device, comprising:

a housing having a first frame, a second frame, an air inlet and an air outlet; and a rotor disposed in the housing, wherein the first frame includes a bearing tube for accommodating a first bearing therein and the second frame includes a support for accommodating a second bearing therein so as to jointly support a shaft of the rotor, and a side wall extending from a periphery of the air inlet inwardly to define an air-gathering chamber in the housing; wherein the air-gathering chamber allows exterior airflow to enter the air inlet, through the air-gathering chamber and then exit from the air outlet.

2. The heat-dissipating device of claim 1, wherein the second frame further comprises an extending part axially extending toward a direction of the first frame to form an axially compressed airflow passage in the housing.

3. The heat-dissipating device of claim 1, wherein the rotor comprises a base, a hub, a first set of blades and a second set of blades.

4. The heat-dissipating device of claim 3, wherein the first set of blades extends downward from a periphery of the hub to a surface of the base and the second set of blades is disposed on the base.

5. The heat-dissipating device of claim 3, wherein the base, the hub, the first and second sets of blades are integrally formed as a single unit.

6. The heat-dissipating device of claim 3, further comprising a driving device disposed in the hub for driving the rotor to rotate.

7. The heat-dissipating device of claim 1, wherein the housing further comprises at least one air inlet formed on the second frame, and an air outlet defined after the first and second frames are assembled.

8. The heat-dissipating device of claim 1, wherein the sidewall has a flange at one end thereof extending radially to define an entrance of the air-gathering chamber.

9. The heat-dissipating device of claim 8, wherein the rotor has a plurality of blades extending toward the entrance of the air-gathering chamber for guiding the airflow into the air-gathering chamber.

10. The heat-dissipating device of claim 1, wherein the air-gathering chamber partially or completely overlaps an air passage through the rotor in height along an axis of the heat-dissipating device.

11. The heat-dissipating device of claim 1, wherein the air-gathering chamber has a cross-sectional area substantially identical to that of the air outlet of the housing.

12. The heat-dissipating device of claim 1, wherein the housing further comprises a plurality of air-guiding members arranged between the sidewall and the support for increasing a blast pressure of airflow passing through the heat-dissipating device.

13. The heat-dissipating device of claim 12, wherein the plurality of air-guiding members are fixed on the sidewall or the support.

14. The heat-dissipating device of claim 12, wherein the plurality of air-guiding members are shaped as strip, plate, curved, inclined or airfoil structures.

15. The heat-dissipating device of claim 12, wherein each of the plurality of air-guiding members has an inclined angle.

16. A heat-dissipating device, comprising:

a housing having a first frame, a second frame, an air inlet, an air outlet and a plurality of air-guiding members; and a rotor disposed in the housing, wherein the first frame includes a bearing tube for accommodating a first bearing therein and the second frame includes a support for accommodating a second bearing therein so as to jointly support a shaft of the rotor;

wherein the air-guiding members are arranged between a sidewall and the support for increasing a blast pressure of airflow passing through the heat-dissipating device, the air inlet is disposed at the second frame and the air-guiding members are located close to the air inlet.

17. The heat-dissipating device of claim 16, wherein the plurality of air-guiding members are fixed on the sidewall or the support.

18. The heat-dissipating device of claim 16, wherein the plurality of air-guiding members are shaped as strip, plate, curved, inclined or airfoil structures.

19. The heat-dissipating device of claim 16, wherein each of the plurality of air-guiding members has an inclined angle.

* * * * *